US007669861B2

(12) United States Patent
Herreid

(10) Patent No.: US 7,669,861 B2
(45) Date of Patent: Mar. 2, 2010

(54) STONE BLOCK TRANSPORTING CRAWLER-CLIMBER

(76) Inventor: Vincent Dean Herreid, 1642 Grayfriars Ave., Holt, MI (US) 48842

( * ) Notice: Subject to any disclaimer, the term of this patent is extended or adjusted under 35 U.S.C. 154(b) by 437 days.

(21) Appl. No.: 11/800,581

(22) Filed: May 7, 2007

(65) Prior Publication Data

US 2008/0279655 A1 Nov. 13, 2008

(51) Int. Cl.
*B62B 5/02* (2006.01)

(52) U.S. Cl. ..... 280/5.2; 280/5.26; 280/5.32; 180/8.1; 180/8.2

(58) Field of Classification Search ..... 280/5.2, 280/5.26, 5.32; 180/8.1, 8.2
See application file for complete search history.

(56) References Cited

U.S. PATENT DOCUMENTS 2,400,824 A * 5/1946 Jackson ..... 180/8.2
2,706,640 A * 4/1955 Marshall ..... 280/5.26
3,241,848 A * 3/1966 Flory ..... 280/5.26
3,283,839 A * 11/1966 Brown et al. ..... 180/8.2
3,411,599 A * 11/1968 Kahlmorgan et al. ..... 180/8.2
3,497,227 A * 2/1970 Porcello ..... 280/5.26
3,497,228 A * 2/1970 Porcello ..... 280/5.26
4,142,732 A * 3/1979 Boyd ..... 280/5.26
4,200,161 A * 4/1980 Penington, Jr. ..... 180/8.2
4,312,417 A * 1/1982 Dalton et al. ..... 180/8.2
4,645,222 A * 2/1987 Hester ..... 280/5.26
6,402,161 B1 * 6/2002 Baghdadi ..... 280/5.2
6,964,309 B2 * 11/2005 Quinn et al. ..... 180/8.1
7,249,640 B2 * 7/2007 Horchler et al. ..... 180/8.6
7,516,502 B1 * 4/2009 Larson et al. ..... 5/626
2008/0007015 A1 * 1/2008 Bidzhiev ..... 280/5.26

* cited by examiner

*Primary Examiner*—Lesley Morris
*Assistant Examiner*—Michael R Stabley

(57) ABSTRACT

Twinned circular, parallel arrays of spoke-like second-class levers (10, 12) enclosing a centered cargo cradle for towing 2½ ton stone blocks (26) up a stepped structure of stone courses (34) by rotation of the whole.

1 Claim, 4 Drawing Sheets

STONE BLOCK TRANSPORTING CRAWLER-CLIMBER

CROSS REFERENCE TO RELATED APPLICATIONS

This invention is modeled after the great pyramid at Giza, Egypt but not limited to this structure.

BACKGROUND

1. Field of Invention

No historical description has been found or is likely to be found of the method used to raise heavy (average 2½ ton) stone blocks upwards for emplacement in the construction of a pyramidal structure in some cases more than 400 feet high.

Of the many books and articles on this subject, the consensus is that ramps of various shapes and of lesser slope than the sides of the pyramid were built to slide the blocks of stone upwards.

The method proposed here in my invention is not mentioned in any previous account of the ancient pyramids.

2. Description of Prior Art

Straight ramps of lesser slope than the sides of the pyramid are of a massive bulk to be constructed and then removed. The length of the haul and the volume of the ramp increases with a lesser slope. A spiral around the pyramid involves a bulky ramp and a far greater distance of haul as compared with a route straight up the side of the structure. Ramps involve massive amounts of friction to overcome. Massive friction must be overcome with massive manpower and massive amounts of time.

My crawler-climber, in comparison, offers a minimum distance of haul as well as being virtually frictionless.

SUMMARY

A stone block carrying, cargo cradle enclosed by symmetrical twinned, circular, spoke-like arrays of levers intended to be towed and advanced by rotation of the whole.

OBJECTS AND ADVANTAGES

The wooden structure of the aforementioned device is estimated at a one ton weight. This brings the total weight including the 2½ ton stone block to about 7,000 lbs.

As the whole is rotated and advanced upwards, the spoke-like levers act in turn as second-class levers, momentarily resting almost half of the total weight on the structure as a lever becomes close to horizontal. As this lever is continued to be rotated close to vertical, it is apparent that almost the total weight rests on the structure.

According to the sin of the 52° slope of the structure, the strain on the pulling rope can be estimated at about 4,400 lbs. at the start of a "pull" varying smoothly to about 500 lbs. at the next belay position.

A "pull" is defined as a rotation of 60° and an advancement of one step from the initial belay position to the next belay position.

FIGS. 1,2, and 3 illustrate a belay position ready for the start of a "pull".

An obvious advantage is the utilization of the shortest possible distance from ground level to the top of the structure in progress.

Another advantage is the almost frictionless advancement of the crawler-climber.

DRAWING FIGURES

Figure 3:
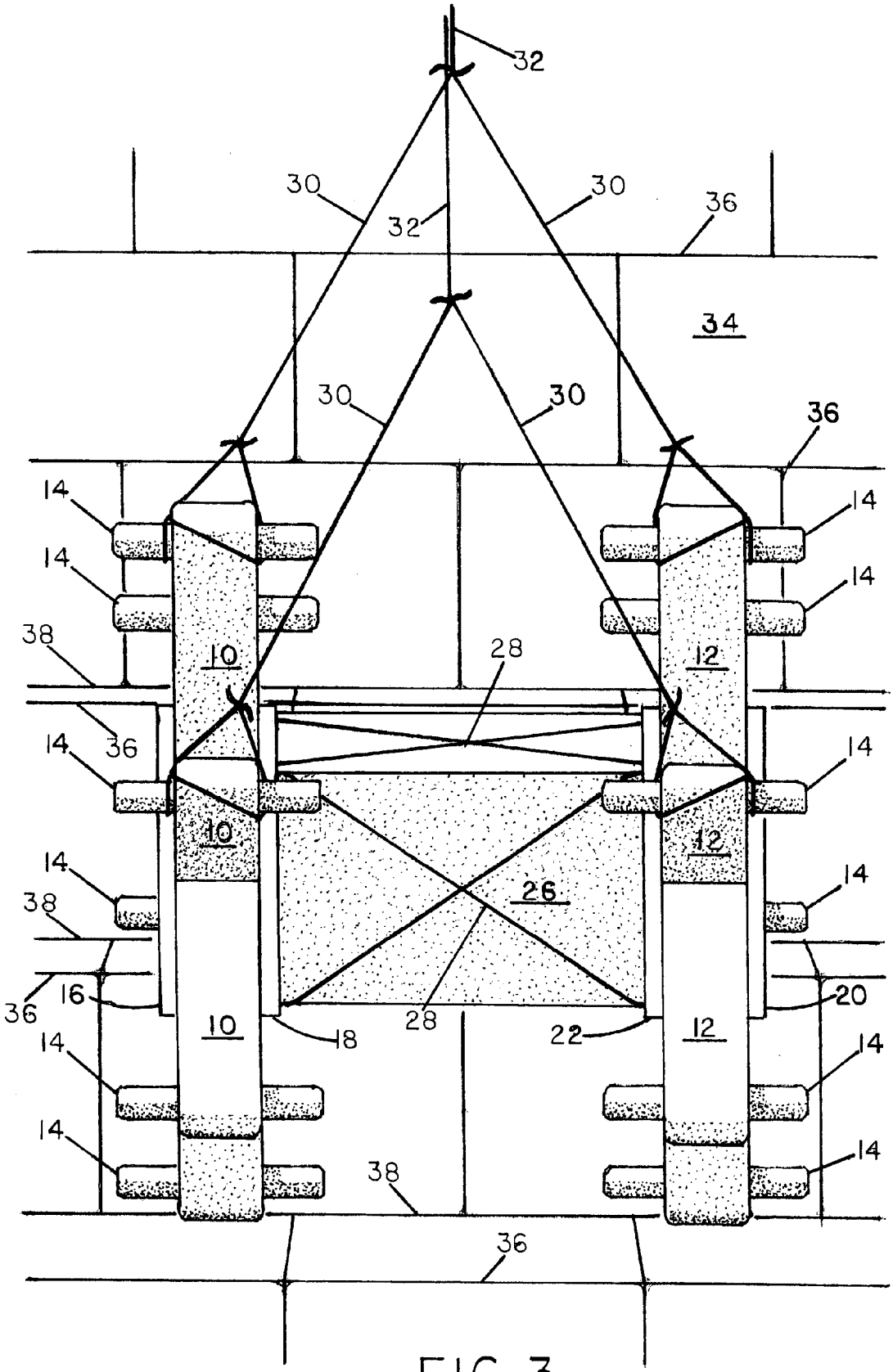

FIG. 3 is a rear horizontal view in belay position with ropes in place to initiate a "pull". Parts are shaded for increased clarity. Also, in the interests of clarity, detail is omitted for the four reinforcing hub plates and for the lashings on the outside right and left.

Figure 1:
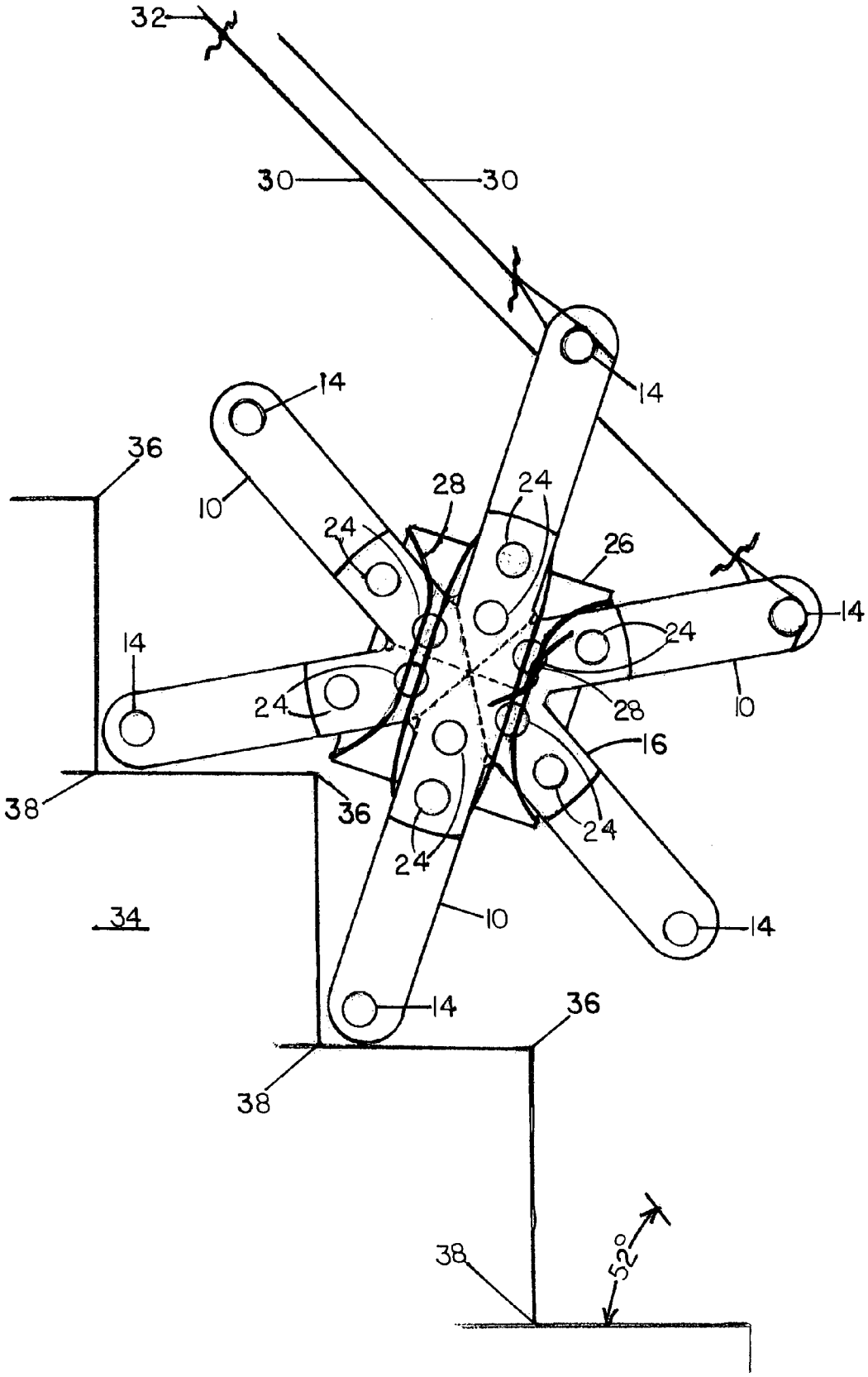
FIG. 1 is a left horizontal view of the crawler-climber in belay position with rope yokes in place to initiate a "pull". Belay position is consecutive pairs of right and left levers in position in receding corners of stone blocks in place.
Figure 2:
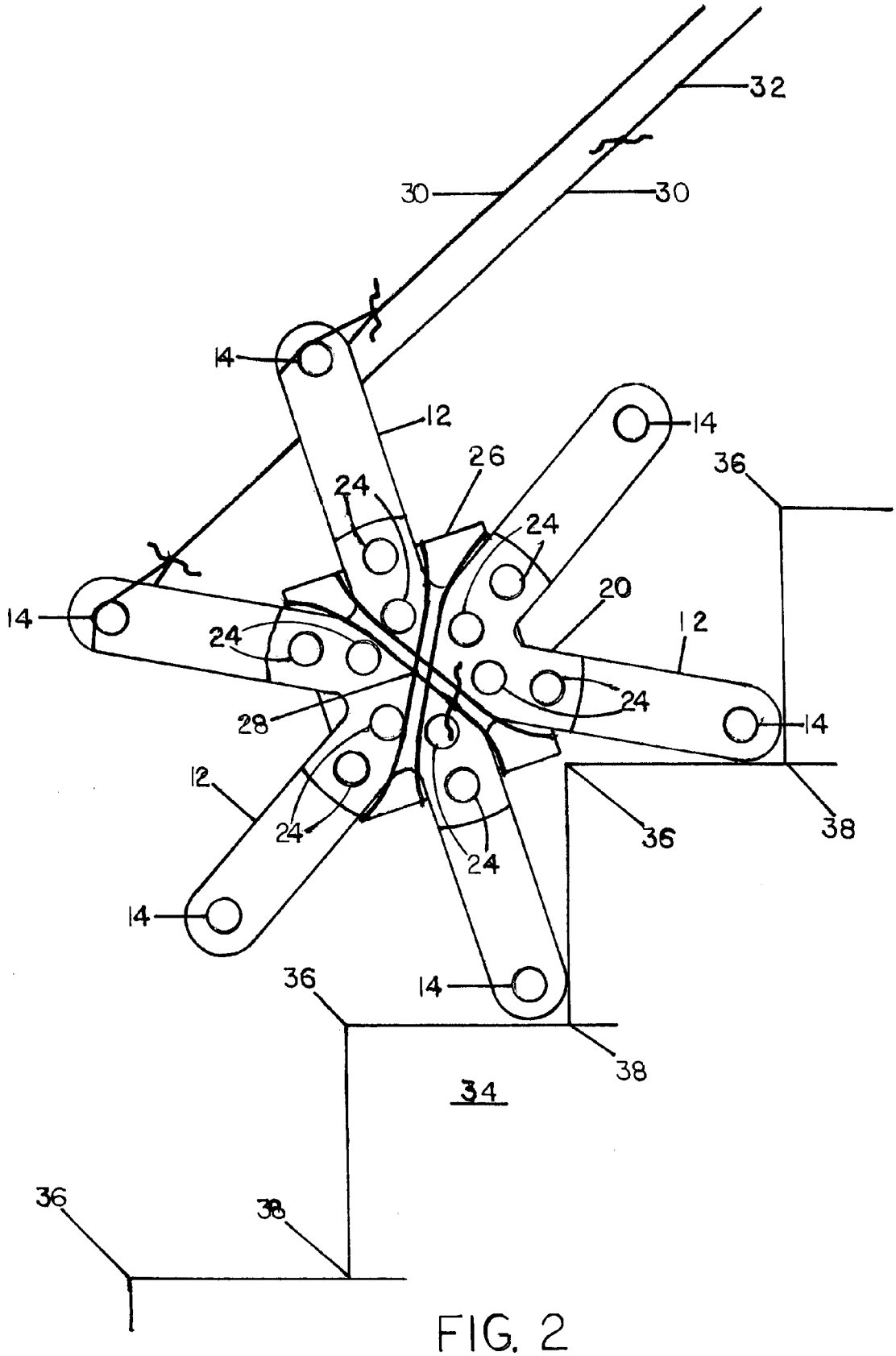
FIG. 2 is a right horizontal view in belay position with rope yokes in place to initiate a "pull".
Figure 4:
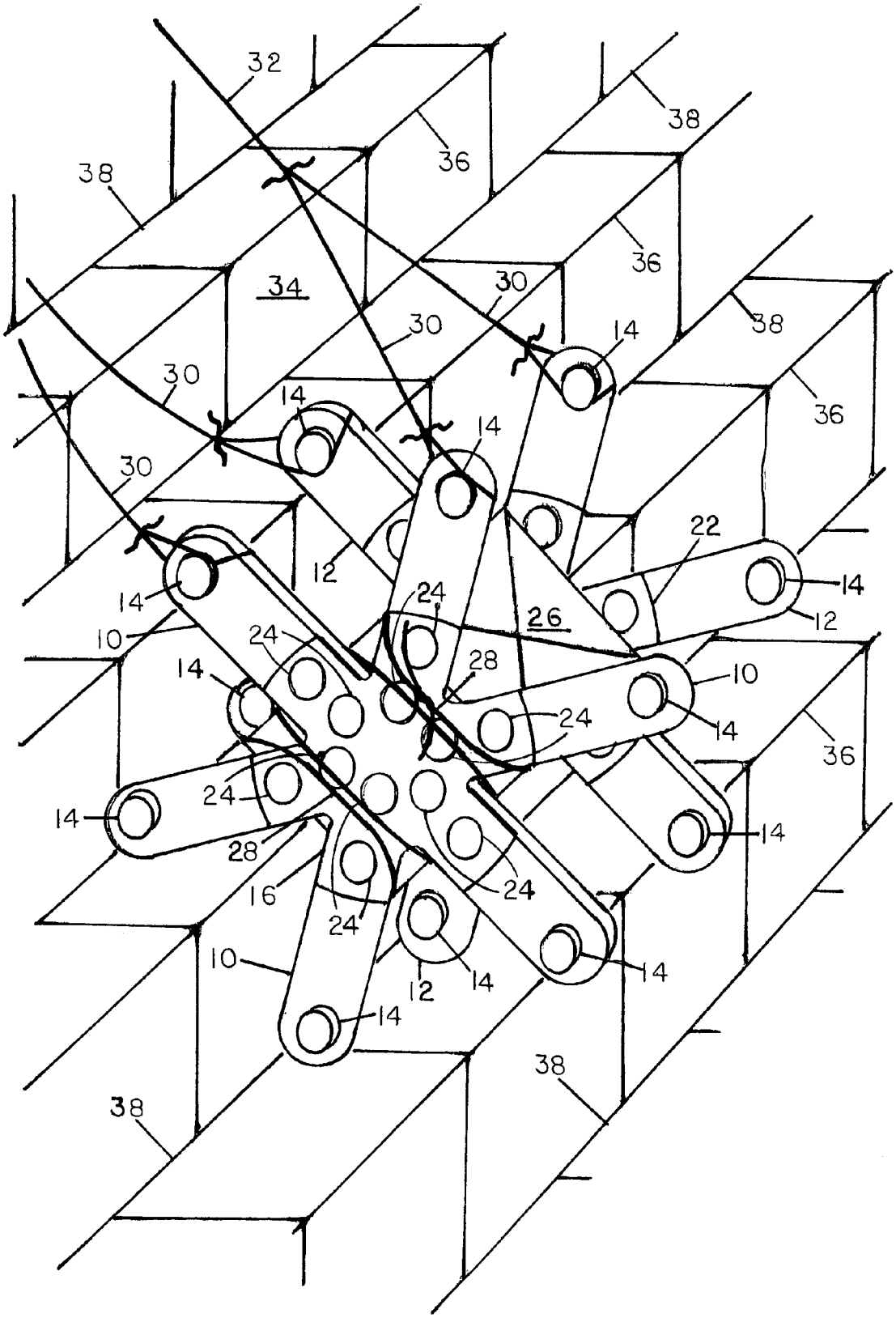

The two interior reinforcing hub plates in contact with the stone cargo are identical to the two outside reinforcing hub plates shown on FIGS. 1,2, and 4.

FIG. 4 is a perspective view from the left, slightly above and slightly to the rear. The crawler-climber is in belay position, with the forward yoke loosened to move it to the second pair of levers to the rear, in position to initiate another "pull".

REFERENCE NUMERALS IN DRAWINGS

| | |
|---|---|
| 10 lever on left side | 12 lever on right side |
| 14 pulling and belaying peg | 16 hub plate on left outside |
| 18 hub plate on left inside | 20 hub plate on right outside |
| 22 hub plate on right inside | 24 hub plate fastening peg |
| 26 stone block | 28 lashing and knots |
| 30 rope yoke and knots | 32 pulling rope and knot |
| 34 stone courses in place | 36 exterior corner |
| 38 interior corner | |

DESCRIPTION-PREFERRED EMBODIMENT

The crawler-climber can be described as twinned spoke-like arrays of levers 10, 12 enclosing a cargo cradle to transport stone blocks 26. The six lever pieces, in each array, are cut symmetrically at a 60° angle to fit snugly together at the middle (FIG. 1) and form three straight second-class levers 10, 12 for each array.

Four identical reinforcing hub plates 16,18,20,22 are fastened two to an array on each side of the array, with pegs 24.

The crawler climber is made of dense strong hardwood with rope or rawhide lashings 28 to fasten the stone block 26 in place.

The double lashing illustrated (FIGS. 1,2, and 4) does not preclude additional lashing and/or framing and studding required to hold the stone block 26 securely in place.

Materials mentioned here are an attempt to duplicate original construction. This patent is intended to include any other materials used to make replicas.

Pegs 14 are fitted and fastened in place near the ends of the levers 10, 12 to provide attachment points for the v-shaped pulling and belaying rope yokes 30.

The v-shaped rope yokes 30 are each attached to a pulling rope 32 as shown on FIGS. 1,2,3, and 4, a short distance in front of the crawler-climber for the best method of propulsion.

The crawler climber is designed to accommodate blocks of stone 26 of about 30 cubic feet and an average weight of about 2½ tons. Blocks of stone, slightly larger than those in place, 34, can be transported without edges of the stone 26 in cargo colliding with exterior corners 36 of stone courses in place 34.

The twinned three lever machine is well suited to the task although other arrangements of levers are possible.

The lever 10, 12 ends are shaped to slide smoothly into the interior corners 38 of stone courses in place 34.

Operation—FIGS. 1,2,3,4

With succeeding pairs of lever ends 10, 12 in position in succeeding interior corners of stone courses in place 38 (FIGS. 1,2,3,4), the machine is in the belay position. The pulling yoke 30 having come to the belay position after the machine has been rotated 60° and advanced one step forwards and upwards.

The previous belay yoke 30 is then moved back two pairs of levers to the pulling position (FIG. 4). Both ropes 32 can be pulled to initiate a rotation of 60° and a climb of one step. Belay is defined as holding in place between "pull" operations.

The slope is steep (52°) but the average strain on the pulling and towing rope 32 is only about 35% of the total 7,000 pound weight, according to the sin of the 52° slope and the operation of the second-class levers.

The strain on the pulling rope 32 varies from about 63% to about 7% of the total weight, from one belaying position to the next.

The crawler-climber can be advanced on the level with bumps inherent to the process of about 8 inches up and then down the same.

CONCLUSION, RAMIFICATIONS, AND SCOPE

The crawler-climber obviously expedites the building of a stepped stone structure by utilizing the shortest possible distance from bottom to top, as well as a virtually frictionless method of raising the stone blocks.

While my above description contains many specificities, these should not be construed as a limitation on the scope of the invention, but rather as an exemplification of the main preferred embodiment thereof.

The rotating arrays of multiple second-class levers used to achieve the stated results, include a machine with two straight levers on each side enclosing the stone cargo. Each two on a side of the second-class levers are fastened and pivoted in the middle to rotate freely through an angle of about 60°. To facilitate this rotation, the stone cargo is fastened to one pair of levers, one lever on each side of the crawler-climber.

The lack of rigidity of this version of the crawler-climber, requires more manpower and more careful handling, but adjusts to succeeding stone courses of varying size blocks.

Adjacent and abutting wooden parts of the crawler-climber can have reinforced fastening by all common means, such as glue, swelling of pegs by soaking in water, and wedges driven into the ends of reinforcing plate pegs.

Accordingly, the scope of the invention should be determined not totally by the embodiment illustrated, but by the appended claims and their legal equivalents.

This is by no means a frivolous invention. I intend to lease it to the motion picture industry. Other unforeseen applications are possible. It is intended to advance knowledge of Egyptology.

I claim:

1. A crawler climber used to transport a stone block upwards on a stepped structure made of similar sized stone blocks comprising:

two spoked arrays, each array comprising:

six levers, each fastened to a first and a second reinforcing hub plate by pegs;

a peg being fastened in place near the end of each lever for use in fastening and releasing rope yokes for a step by step advancement of the crawler climber up the side of the structure;

a stone block lashed between the two arrays via a rope or rawhide lashing;

wherein the levers are pivoted up the structure in relation to each other to fit succeeding levers into succeeding interior corners of the structure in order to transport the stone block up the side of the structure.

* * * * *